US006458020B1

(12) United States Patent
Brigante et al.

(10) Patent No.: US 6,458,020 B1
(45) Date of Patent: Oct. 1, 2002

(54) SLURRY RECIRCULATION IN CHEMICAL MECHANICAL POLISHING

(75) Inventors: Jeffrey A. Brigante, Colchester, VT (US); Thomas L. Conrad, Aloha, OR (US); David J. Fontaine, Williston, VT (US); Rock Nadeau, Jericho, VT (US); Paul H. Smith, Jr., Essex Junction, VT (US); Theodore G. van Kessel, Millbrook, NY (US)

(73) Assignee: International Business Machines Corporation, Armonk, NY (US)

( * ) Notice: Subject to any disclaimer, the term of this patent is extended or adjusted under 35 U.S.C. 154(b) by 0 days.

(21) Appl. No.: 09/683,086

(22) Filed: Nov. 16, 2001

(51) Int. Cl.[7] ..... B24B 1/00
(52) U.S. Cl. ..... 451/285; 451/60; 451/446
(58) Field of Search ..... 451/36, 59, 60, 451/259, 446, 290, 550, 285–289

(56) References Cited

U.S. PATENT DOCUMENTS 4,910,155 A * 3/1990 Cote et al. ..... 437/8
5,538,462 A * 7/1996 Gnadt ..... 451/114
5,664,990 A 9/1997 Adams et al.
5,702,291 A * 12/1997 Isobe ..... 451/41
5,791,970 A * 8/1998 Yueh ..... 451/8
6,019,665 A 2/2000 Lee et al.
6,051,499 A 4/2000 Tolles et al.
6,106,728 A * 8/2000 Iida et al. ..... 210/743
6,110,025 A 8/2000 Williams et al.
6,116,993 A * 9/2000 Tanaka ..... 451/287
6,126,531 A * 10/2000 Iida et al. ..... 451/447
6,159,082 A * 12/2000 Sugiyama et al. ..... 451/285
6,200,202 B1 * 3/2001 Eastman, Jr. et al. ..... 451/99
6,347,979 B1 * 2/2002 Drill ..... 451/41

* cited by examiner

*Primary Examiner*—George Nguyen
(74) *Attorney, Agent, or Firm*—Robert A. Walsh

(57) ABSTRACT

A recirculation mechanism is used to force slurry toward the center of a platen used for chemical-mechanical polishing. The recirulator captures the slurry that would otherwise be flung from a rotating platen because of centrifugal force. The captured slurry is forced upwardly away from the surface of the platen and toward the center of the platen to recycle the slurry.

6 Claims, 4 Drawing Sheets

SLURRY RECIRCULATION IN CHEMICAL MECHANICAL POLISHING

Background of the Invention

1. Field of the Invention

This invention relates generally to integrated circuit manufacturing, and micro-machining and more specifically to processes for the chemical mechanical polishing of semiconductor wafers and package mounts.

2. Background of the Invention

Chemical mechanical polishing (CMP) processes are commonly used in the manufacture of integrated circuits to planarize wafer surfaces. As shown in the prior art cross-sectional schematic drawing of FIG. 1, typical CMP systems include a semi-porous polishing pad 17 mounted on the upper surface of a planar platen 16. The polishing pad is wetted with a chemically reactive, abrasive slurry from a supply tube 18. Commonly, the platen is relatively large in comparison to a wafer 12 to be planarized and is rotated during the polishing process. Wafer 12 is held by means of a wafer carrier 11, which typically is capable of transverse movement 15 and also rotational movement about a shaft 14. The rotational and transverse movement of the wafer with respect to the polishing pad facilitates uniform CMP etch rates across the wafer surface.

There are many variables that affect the ability of a specific CMP process to planarize a wafer surface. These include the pressure between polishing pad 17 and wafer 12, the hardness of polishing pad 17, the slurry composition, and the relative motion between the platen and the wafer (e.g., platen and wafer rotation rates). One important variable of a CMP process is the rate at which fresh polishing slurry is supplied. During a CMP process, chemical components of the slurry are continuously consumed by the polishing process. Waste by products of the polishingBUR920000208US1—process are also generated. The nature of the deleterious waste products will depend upon the particular polishing process, but may include reacted chemical by-products of the polishing process, degraded polishing pad components, or particulates from the abrasive component of the slurry. The chemical and mechanical aspects of the polishing process may change if the active components of the polishing slurry become depleted or if deleterious waste products build up. A constant flow of fresh slurry to the platen is thus desirable to replenish the active components of the slurry and to flush out deleterious waste products.

Fresh slurry is typically supplied to wafer 12 on a continuous basis, such as by dripping a continuous stream of slurry from supply tube 18 onto a portion of pad 17. In addition to refreshing the reacted or depleted slurry, slurry must also be supplied because centrifugal force tends to fling slurry off of the edge of the platen as the platen rotates. As shown in the prior art cross-sectional drawing of FIG. 2, polishing pad 17 rotates at an angular velocity Wp. The equivalent linear speed (L) of the polishing pad at a radius, r, from a central axis 0, is WpX r. Also, as shown in FIG. 2 the wafer 12 may also be rotated about its axis at an angular velocity Ww At high platen rotation rates, a substantial flow of fresh slurry onto the polishing pad 17 from the supply tube 18 may be required to compensate for slurry flung off from the edges of the platen. Also, at high platen rotation rates, substantially larger quantities of slurry are flung from the platen and at a higher velocity. This increases the difficulty of containing slurry chemicals and particulates proximate to the polishing system. Additionally, the increased slurry consumption increases the cost of the polishing process. Another problem associated with high platen rotation rates is that the polishing pad may become unevenly wetted. The edge regions of the pad will tend to become substantially wetter than the center most pad regions because of the effect of centrifugal force. This is highly undesirable as it may result in non-uniform polishing across the polishing pad. The requirement for uniformity also frequently requires that the wafer carrier be positioned at the extreme limit of the polishing platen. In this polishing configuration, the carrier is flush with the edge of the polishing platen and slurry is actively pushed off the pad. It is desirable to reduce the total amount of slurry consumed in the process while at the same time achieving uniform and consistent delivery of slurry to the wafer being polished. It has been observed as a consequence of the above discussion that the vast majority of the slurry flows off the polishing pad without ever contacting the wafer being polished. Slurry recirculation methods have been attempted as a solution to this problem.

One such attempted solution to these problems is flood polishing. In flood polishing schemes, dams are erected around the circumference of the platen or carrier to hold in the polishing slurry. Flooding the platen with a deep pool of slurry facilitates wetting the entire pad. The dam acts to retain the slurry from being flung off of the platen such that typically no additional slurry is dripped onto the platen during the polishing process. However, such flood polishing schemes have several limitations. First, in common flood polishing schemes, there is no simple technique to continuously refresh consumed slurry components and to flush out deleterious waste products. The level of polishing slurry is typically chosen to flood the entire platen with approximately a quarter inch (6.35 mm) of slurry in order to provide a reservoir of polishing components to supply all polishing needs. Additionally, the slurry reservoir must be large enough that waste products do not build up to deleterious levels. Second, in conventional flood polishing methods, there is no simple way to continuously adjust the slurry depth as a function of platen rotation rate. This is undesirable because fixing the slurry depth at one initial level will tend to limit the variations in platen rotation rate that are feasible during the polishing process. For example, because flood polishing uses a deep pool of slurry, it may suffer from undesirable hydroplaning at high platen rotation rates. In the most general case, the mechanical energy imparted by the polishing pad to the wafer will depend both on platen rotation rate and upon the slurry depth. Fixing the slurry depth at a constant level thus limits the ability of a process engineer to control the mechanical component of a chemical mechanical polishing process.

Another strategy has been to recirculate slurry from the drain through a reservoir to an inline filter and back to the polishing pad using a pump. In this, and the above case, the normal rinsing of the pad between wafers is not possible because it would dilute and alter the recirculated slurry. These and other methods have been attempted without general success to reduce slurry consumption due to accumulated waste material causing defects on the polished part. What is desired is an apparatus and method to increase control of the flow of polishing slurry on a rotating platen used in a chemical mechanical polishing process while at the same time reducing the total volume of slurry consumed.

SUMMARY OF THE INVENTION

The present invention generally comprises a localized recirculation mechanism used in a chemical-mechanical process which collects and recirculates slurry on the platen near the outboard edge of the wafer carrier. This mechanism captures the slurry before it is flung off the platen and provides a pumping action to force the slurry towards the wafer which is being polished. This is accomplished by providing a wedge shaped slurry pickup head containing a cavity which is shaped to create a fluid flow stagnation point. The configuration of the device captures the slurry and sufficient static pressure to lift the slurry upwards for a short vertical distance. From this elevated position, the slurry is flows under force of gravity along a trough from which it is re-deposited at the center of the platen. This method is most effective at medium to high platen rotation speeds. At low platen rotation speeds the static pressure generated is less. Alternatively in the case of low platen speed, the slurry trough is replaced by a connection to an external pump and tube assembly to route the slurry from the pickup head and return it to the center of the platen.

This assembly has several distinct advantages:

1. Slurry is recirculated locally for the duration of one wfer after which the normal rinse process cleans all parts including the recirculator. This has the benefit that waste materials which might otherwise cause defects do not accumulate in the slurry. Reductions of 30–50% have been demonstrated resulting in significant cost savings.

2. The wedge shaped slurry pickup forces a large accumulation of slurry along the leading edge of the wafer carrier. This has the effect of dramatically improving the slurry supply to the wafer. Again this has a positive impact in the sense of reducing polish defects.

The present invention is also directed to a method of chemical mechanical polishing method, the localized recirculation which forces the slurry to the center of the platen.

DETAILED DESCRIPTION OF THE INVENTION

The inventors have realized that the ideal polishing system should conserve slurry while also providing desirable flows of fresh slurry to continuously replenish the polishing components of the slurry and to flush out deleterious waste by-products of the polishing process. The inventors have also realized that it would be advantageous to have a polishing system which conserves the slurry used on the platen prior to it being discarded. The conserved slurry is directed to a position that it can be effectively reused and controlled. This has advantages in terms of the quality of the polishing process. For example, in some polishing processes there may be insufficient slurry replenishment if the slurry level near the wafer being polished. Control over the slurry level near the wafer may also offer other benefits as well. For example, if the slurry level is too deep, it may flood the polisher and exacerbate the problems of equipment maintenance. Additionally, the inventors have realized that the slurry near the wafer is an additional factor that affects the mechanical aspects of the polishing process. A practical method to control the slurry near the wafer would permit new polishing processes in which the slurry on the platen was adjusted during the process, unlike conventional polishing processes in which the slurry is primarily limited to either an extremely thin film or to flood polishing conditions.

The present invention generally comprises a recirculation device used in a chemical mechanical polishing process. The recirculation device operates on Bernoulli principles known in hydrodynamic engineering. The device forms a dam with the carrier near the edge of the platen to prevent the slurry from being discarded. This dam also creates a local fluid stagnation point at which sufficient pressure exists to force the trapped slurry upwards to a vertical point from which it is allowed to flow under gravity toward the center of the platen via a trough provided for the purpose. An external pump may be used to assist in redirecting the slurry to the center of the platen. The present invention can be realized as a mechanism and process for efficiently utilizing the slurry carried on the platen. Allows operation using low system volume of slurry which reduces potential for contamination. The process allows the platen to be rinsed more efficiently so that each wafer will see fresh slurry. The partial slurry recirculaton allows a constant flow of fresh slurry to reduce possible concentration of concentration variation effects. Concentration of slurry flow against the side of the wafer carrier causes more effective flow of slurry under the wafer. The effect is equivalent to using 2 to 3 times normal slurry volume due to the slurry leading edge effect. Using an external pump facilitates the control in order to program the recirculation flow rate, timing and generally improves the robustness and enables operation of the system at low platen speeds.

Figure 1:
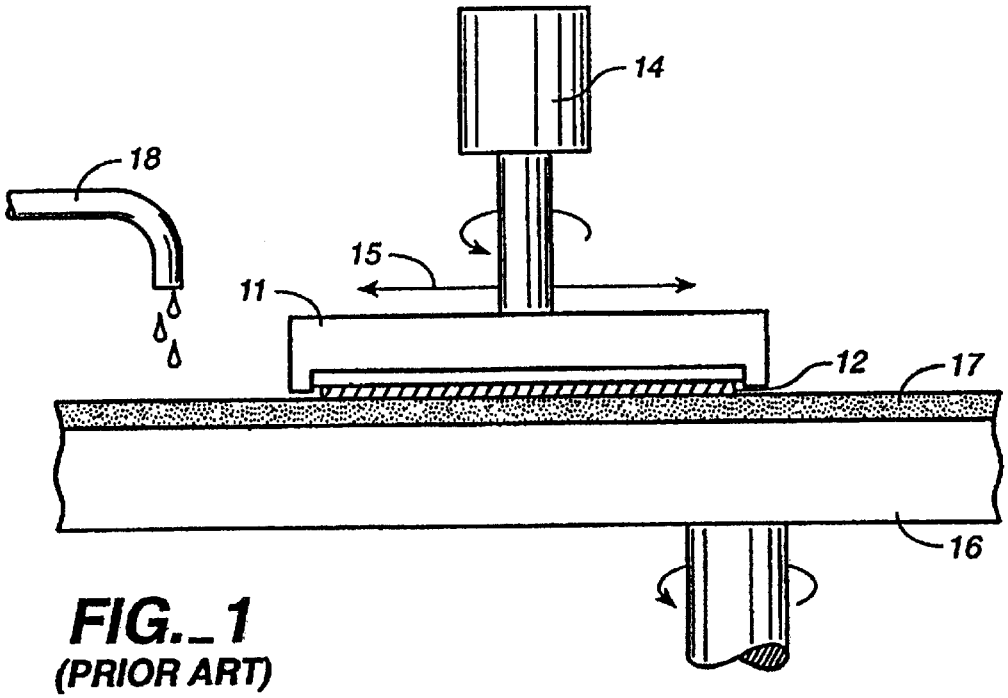
FIG. 1 (PRIOR ART)
FIG. 1 shows a prior art cross-sectional schematic diagram of a conventional chemical-mechanical polishing system.
Figure 2:
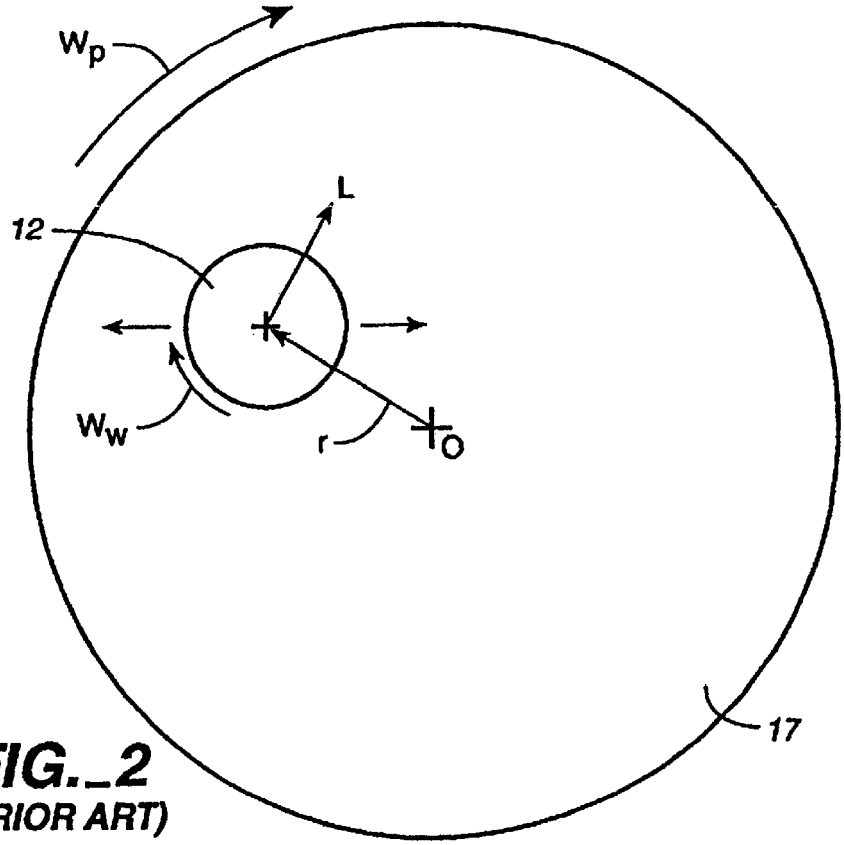
FIG. 2 (PRIOR ART)
FIG. 2 shows a prior art schematic top view of a chemical mechanical polishing system showing the relative motion of the platen and the substrate.
Figure 3:
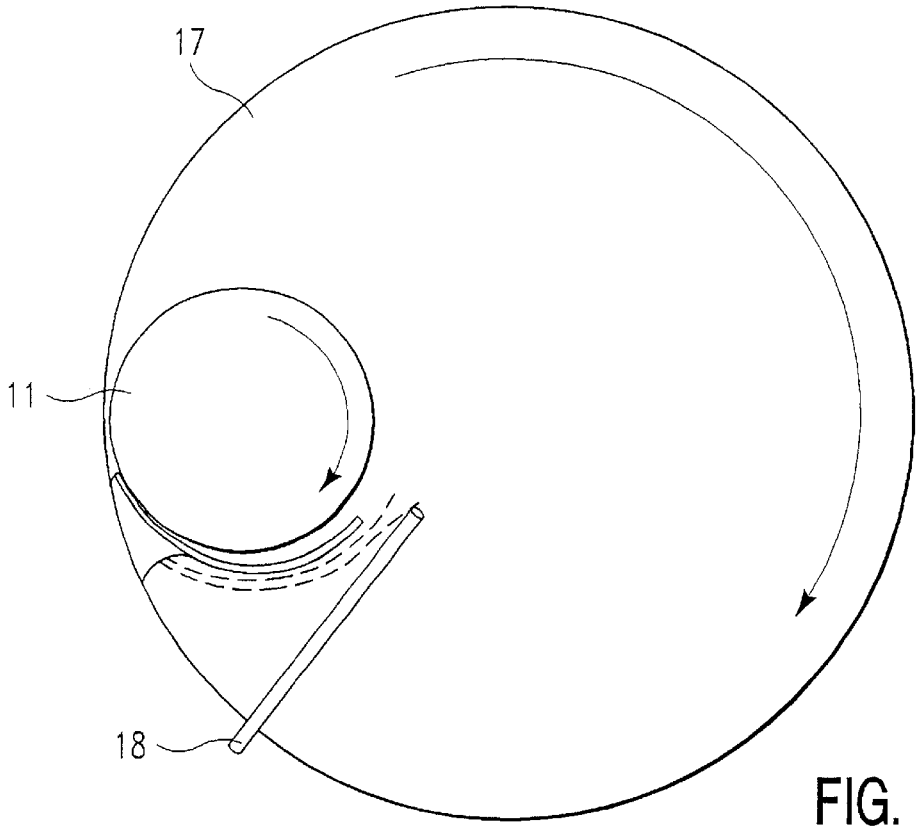
FIG. 3 shows a plan view of a recirculation mechanism platen in accordance with the present invention.
Figure 4A:
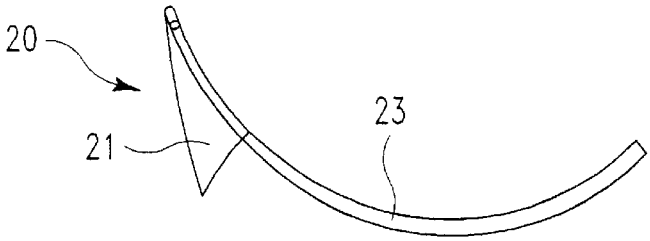
FIG. 4 is a detailed, top view (4*a*); expanded cross-sectional top view (4*b*) and side view of a recirculation device (4*c*) shown in FIG. 3 constructed according to the present invention by which the flow of fresh slurry to the platen is forced toward the center of the platen.
Figure 4B:
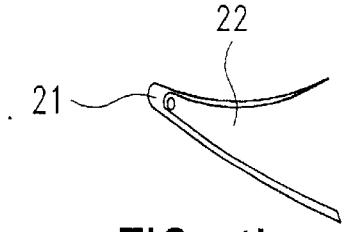
Figure 4C:
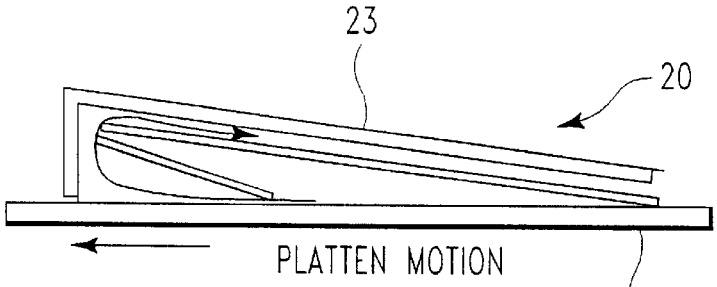

As shown in FIGS. 3 and 4, the present invention comprises a recirculation device 20 placed in close proximity to the carrier 11 in order to trap the slurry which would otherwise flow outwardly off the polishing pad 17 due to centrifugal forces acting on the slurry on a rotating platen 16. The dynamics of the system forces the slurry into the cavity portion 21 of device 20. This cavity 21 is shaped to create a fluid stagnation in the fluid flow of the slurry which is shown in more detail in FIG. 4. The stagnation creates a static pressure which lifts the slurry up above the platen short distance and into a channel portion 22 of the device 20, and along trough portion 23 outwardly toward the center of the platen 16. As indicated above the recircultion device 20 ishown in more detail in FIGS. 4(*a*), 4 (*b*) and 4 (*c*). In particular, FIG. 4(*a*) shows the top view of the wedge shaped cavity 21 and the slurry return trough 23. FIG. 4(*b*) illustrates the top view of device 20 in cross section to illustrate the funnel 22 geometry. FIG. 4(*c*) shows the cross section side view of device 20 to illustrate the direction of the slurry flow upward and outward through trough 22.

Figure 5:
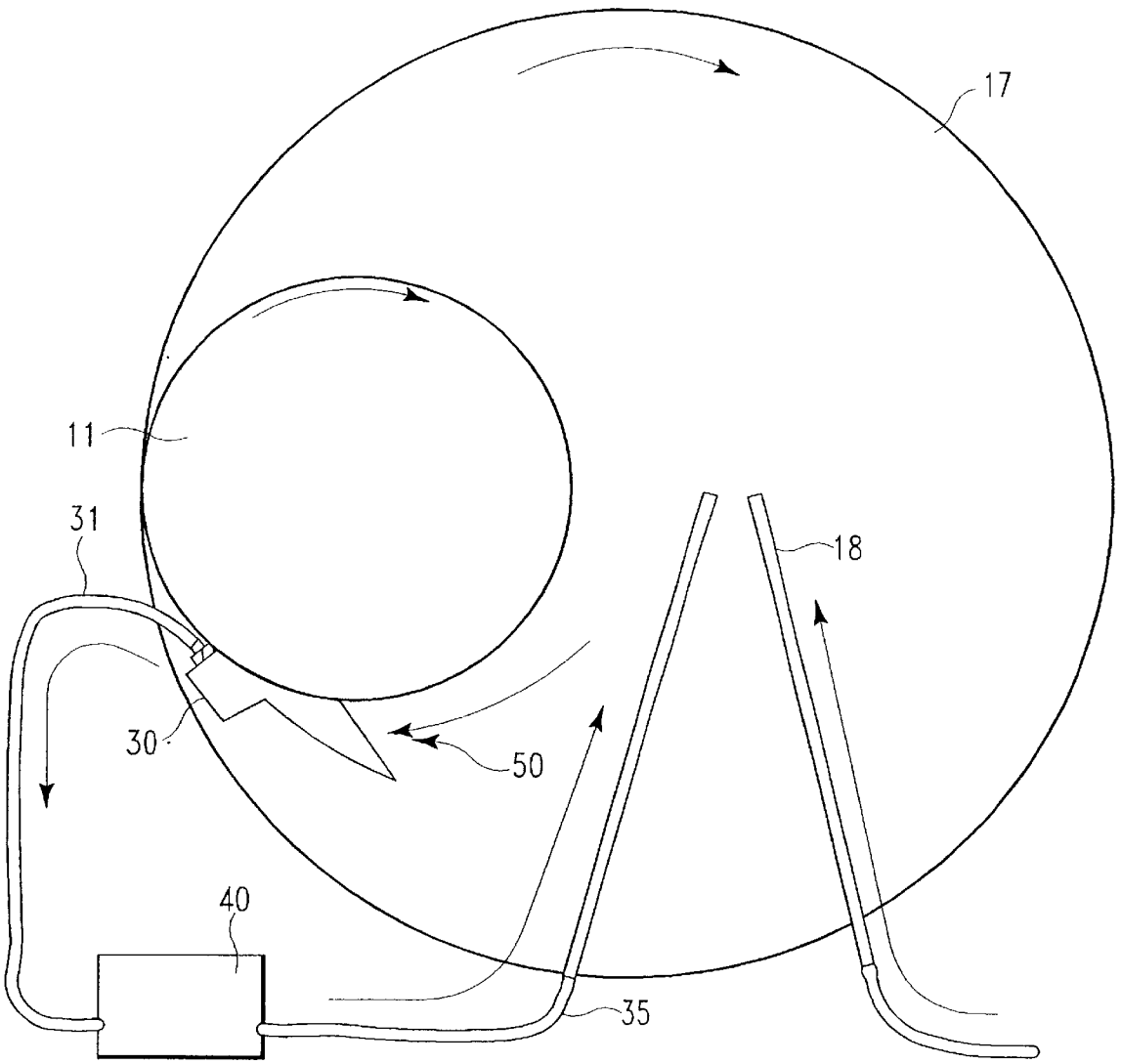
FIG. 5 is a plan view of an alternate embodiment of a recirculation mechanism in accordance with the present invention.
Figure 6A:
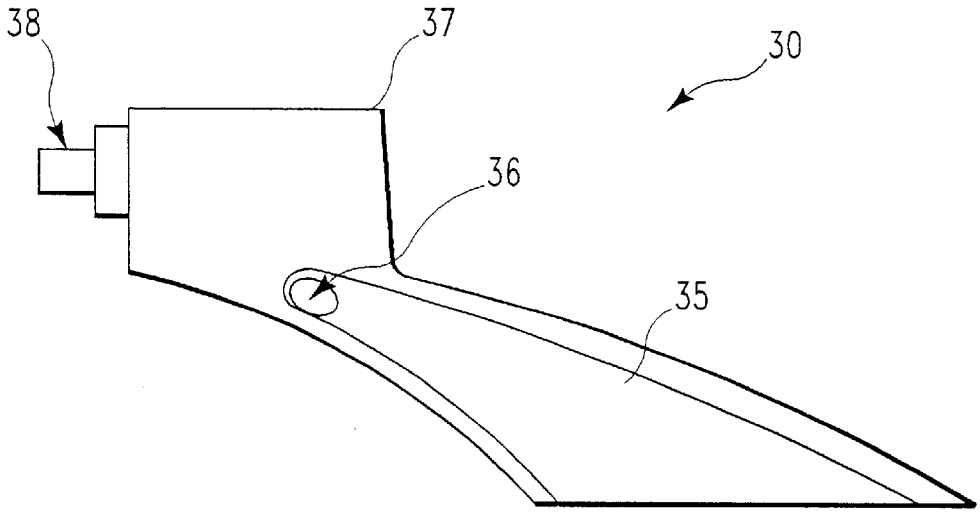
FIG. 6 is an enlarged bottom view (6*a*); side view (6*b*) and top view (6*c*) of the alternative recirculation head shown in FIG. 5.
Figure 6B:
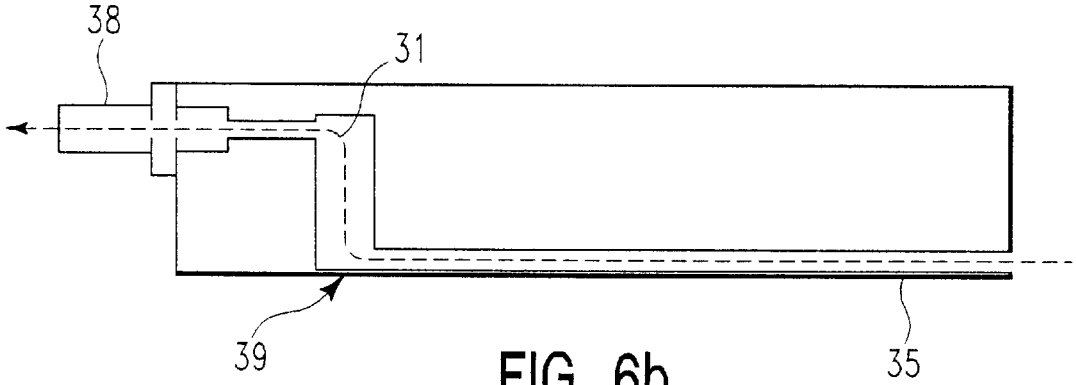
Figure 6C:
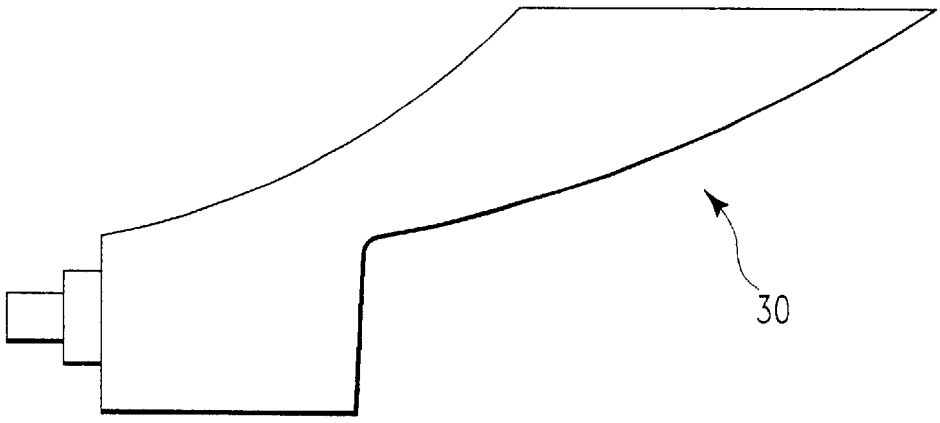

In another embodiment shown in FIGS. 5 and 6, the movement of the slurry toward the center of the platen may be assisted by a pump. In this embodiment the slurry is trapped by a dam region 50 between the carrier and the collection head of the recirculation device 30 adjacent the carrier 11. The slurry passes through the recirculator 30 along a channel 31 within the recirculator 30. The collected slurry is conducted through an exit tube 31 to a pump 40. The pump forces the reclaimed slurry back to the polishing pad near the carrier through a supply tube 35. The pump preferably used is a peristolic type which is capable of sucking the slurry from the collection head 30 and returning it to the central region of the polishing pad. The recirculator 30 is shown in more detail in FIGS. 6(*a*), 6(*b*) and 6(*c*). In particular, FIG. 6(*a*) illustrates the bottom view showing a slurry dam and accumulation cavity area 35 which captures the slurry in recirculator 30. The captured slurry passes through an exit port 36 into a mounting block 37 to an exit coupling 38 to the exit tube 31. FIG. 6 (*b*) illustrates a cross sectioned side view of recirculator 30 showing the slurry path from the accumulation cavity area 35 to a stagnation point 39 and upwards through the mounting block 37 to the exit coupling 38. FIG. 6(*c*) illustrates the top view of the recirculator 30 as shown in FIG. 5.

As now should be understood in operation of this embodiment of the recirculator captures and gathers slurry adjacent to the spinning wafer carrier on the polishing platen that would otherwise flow off the platen. This slurry is channeled through the recirculator into an exit tube that is attached to an external pump. The pump sucks the slurry from the collection head and returns it to the central region of the polishing platen. This operation provides efficient partial slurry recirculation which allows a constant flow of fresh slurry thereby reducing potential concentration variation effects. The concentration of slurry flow against side of wafer carrier causes more effective flow of slurry under wafer. Effect is equivalent to using 2–3 times normal slurry volume. The use of an external pump allows programmable recirculation flow rates of the slurry to meet the polishing requirements of the system. In addition the external pump also allows time control on recirculation as well as enables operating the system at low platen speeds.

Although specific embodiments of the present invention have been illustrated in the accompanying drawings and described in the foregoing detailed description, it will be understood that the invention is not limited to the particular embodiments described herein, but is capable of numerous rearrangements, modifications and substitutions without departing from the scope of the invention. The following claims are intended to encompass all such modifications.

What is claimed is:

1. Apparatus to recirculate slurry used in chemical-mechanical process for polishing semiconductor wafers attached to a carrier comprising:

a recirculator positioned on top of a rotating polishing platen adjacent the carrier near an edge of a platen the recirculator being in contact with the carrier whereby the slurry is captured between the carrier and the recirulator and forced upward away from the top surface of the platen and toward the center of the platen.

2. In a chemical-mechanical machining process with a rotating polishing platen and a rotating wafer carrier with a slurry recirculator comprising a pickup head positioned near the rotating wafer carrier on top of the rotating polishing platen wherein the combined motion of the slurry, wafer carrier and polishing platen forces the slurry into the pickup head; means for accumulating the slurry; and means for returning the slurry to the central region of the polishing platen.

3. Apparatus as in claim 2 where the force is applied by a Bernoulli pump as an integral part of the intake head.

4. Apparatus as in claim 2 where the force is applied by of a peristolic pump.

5. Apparatus as in claim 2 where slurry is forced back to the central region of the polishing platen under gravity using a trough.

6. Apparatus as in claim 2 where the force is applied by a positive displacement pump.

* * * * *